United States Patent [19]

Gaertner

[11] 4,250,557

[45] Feb. 10, 1981

[54] INTEGRATOR HAVING DROP-OUT CIRCUIT

[75] Inventor: Max Gaertner, Warminster, Pa.

[73] Assignee: Fischer & Porter Company, Warminster, Pa.

[21] Appl. No.: 50,324

[22] Filed: Jun. 20, 1979

[51] Int. Cl.[3] ..... G06J 1/00

[52] U.S. Cl. ..... 364/605; 235/92 FL; 235/92 TF; 364/510

[58] Field of Search ..... 364/464, 465, 466, 509, 364/510, 567, 570, 571, 574, 600, 602, 605, 829; 235/92 T, 92 TF, 92 FQ, 92 FL, 92 WT; 177/3, 15, 16, 25, DIG. 3; 73/194 R, 194 E, 206, 227

[56] References Cited

U.S. PATENT DOCUMENTS

| | | | |
|---|---|---|---|
| 3,505,673 | 4/1970 | James | 364/605 X |
| 3,754,126 | 8/1973 | Williams, Jr. | 364/605 X |
| 4,075,701 | 2/1978 | Hoffmann | 364/605 X |

*Primary Examiner*—Joseph F. Ruggiero
*Attorney, Agent, or Firm*—Michael Ebert

[57] ABSTRACT

An integrator for totalizing with respect to time an input signal representing a process variable being metered to provide a total reading for a given period. The integrator includes a drop-out circuit functioning to abruptly reduce to zero the signal fed to the totalizer when the input signal falls below a predetermined level where it no longer accurately reflects the variable. The input signal is applied to a duty-cycle converter that cyclically generates a rectangular wave whose ON period has a duration which is a function of the input signal, the higher the signal level, the shorter the OFF period in the cycle. Clock pulses at a constant frequency are normally supplied to a totalizer during the ON period. A drop-out counter functions to count the clock pulses during the OFF period, the number of pulses counted representing the duration of this period. If the OFF period duration exceeds the setting of the drop-out counter, the counter acts to inhibit the supply of clock pulses to the totalizer in the succeeding ON period so that the input signal as then seen by the totalizer is effectively zero.

8 Claims, 4 Drawing Figures

NAND

| A | B | = C |
|---|---|---|
| 1 | 1 | 0 |
| 1 | 0 | 1 |
| 0 | 1 | 1 |
| 0 | 0 | 1 |

NOR

| A | B | = C |
|---|---|---|
| 0 | 0 | 1 |
| 0 | 1 | 0 |
| 1 | 0 | 0 |
| 1 | 1 | 0 |

INTEGRATOR HAVING DROP-OUT CIRCUIT

BACKGROUND OF INVENTION

Field of Invention

This invention relates generally to integrators for totalizing with respect to time a signal whose level represents a process variable being measured to provide a total reading for a given period, and more particularly to a digitally settable drop-out for an integrator.

As explained in the article entitled "Signal Integrators" which appeared in the April 1966 issue of *Control Engineering* (page 76 et seq.), integrators may be used for totalizing an input signal representing any variable being measured. For purposes of illustration, however, we shall only consider integrators operating in conjunction with flow rate meters.

The present invention is addressed to problems arising in "drop-out" expedients presently included in such integrators. When a process is actually at zero, there is often some residual error signal from the process transmitter to the integrator. Thus some flowmeters have a square law function, which results in very large error signals under minimum flow conditions. Moreover, a small zero shift can also simulate a flow signal even though flow has ceased altogether.

Drop-out is the term generally used in the industrial process control industry to define expedients functioning to abruptly reduce a signal to zero when the signal falls below a predetermined level. A drop-out expedient in an integrator therefore serves to inhibit totalization when the input signal is at a level where it does not truly reflect the variable being measured, but represents a spurious value which, if added to the totalizer, would produce a misleading reading.

Since known forms of integrators are of the mechanical, electronic and pneumatic type, we shall consider typical integrators in each of these classes as well as the existing expedients incorporated therein to afford a drop-out action The mechanical integrator manufactured and sold by Fischer & Porter of Warminster, Pa. (F&P) and described in their Instruction Bulletin 52 T-4000B (August 1972) is included as a component in a flow rate measuring instrument to show the total cumulative quantity of the flowing fluid that is being metered by the instrument. This mechanical integrator receives its input signal via a connecting link from the instrument spindle that is indicating the process. The link acts to position a cam whose profile is shaped to represent the flowmeter curve.

A synchronous motor is used to operate the integrator, the motor driving a drive wheel with a pin mounted off center. As the pin moves through its orbit, it drives a spring-loaded follower arm, the follower arm causing a timed oscillation of the main shaft. A contact arm attached to the opposite end of the main shaft detects the profile of the cam representing the process.

If, therefore, the process variable is at 100% scale, the contact arm will oscillate through a 30% arc. At lesser process variable values, the contact arm travel is limited by the higher cam profile. Thus for each position of the cam, there is a discrete angle of rotation produced on the main shaft. Summation of the main shaft rotation is effected by means of a unidirectional clutch attached thereto. Actuation of this clutch engages a digital counter or odometer in the return stroke of the main shaft of the counter providing the desired total.

In the F&P mechanical integrator, the cam is profiled so that there is a step cut therein at the largest cam diameter. This is the zero input portion of the cam, and the step, therefore, functions as the drop-out expedient for the integrator.

The drawback of a mechanical integrator of this type, apart from its inherent mechanical limitations and complexity, is that the drop-out point is fixed and cannot be adjusted to meet varying situations which may dictate different drop-out settings to inhibit spurious signals.

In the pneumatic integrator manufactured by the Hokushin Electric Company of Japan and described in their Instruction Manual (August 1972) for Model ALI 101/102 (Bulletin No. E642-101), an incoming pneumatic signal representing flow rate is converted into a proportional lever displacement through a bellows-spring mechanism. The lever is U-shaped and carries on one of its arms a light-emitting diode and on the other, a photo sensor for picking up the light beam emitted by the diode. The diode is excited by electrical pulses at a constant repetition rate (i.e., 120 Hz).

A profiled vane rotated by a synchronous motor is interposed between the diode and the photo sensor to interrupt the light beam. The profile of the vane is such that the number of light pulses counted per single cycle of vane rotation is proportional to the input signal or its square root value. A frequency divider coupled to the output of the photo sensor reduces the counting rate of the pulses applied to an electronic counter which totalizes the count.

In the Hokushin integrator, in order to prevent erroneous counting at low flow rates (at less than 10% of full scale for linear signals, and less than 9% for square root signals), the vane has a drop-out step machined therein. Here again, the dropout is fixed; and while this is a low-cost approach, it makes no provision at all for situations requiring different drop-out settings.

An adjustable drop-out is included in the electronic integrator manufactured by F&P and disclosed in their Instruction Bulletin 52 ET 3000 (July 1973). This electronic integrator acts to totalize an electronic signal (i.e., 4–20 mA) with respect to time and to read the total for any given period. Operation of this electronic integrator is based on the integrating capability of an operational amplifier and utilizes a field effect transistor input amplifier as the active element. In order to keep the differential voltage at zero, the amplifier must force a charging current into a feedback capacitor that is equal to the current through the input resistance. Thus the rate of change of the output voltage (capacitor voltage) is proportional to the input voltage. Since this output voltage varies at a rate proportional to input voltage, the output is proportional to the integral of the input.

This electronic integrator includes a drop-out circuit to inhibit output counts whenever the count rate falls below a level selected by a drop-out potentiometer in an RC type of timer operating in conjunction with a frequency detector which senses the time interval between pulses by charging and discharging a capacitor once each flip-flop cycle.

If the time between pulses exceeds the period determined by the RC time constant, a reset pulse is applied to the scaler registers. While this type of drop-out is settable, it is subject to a large margin of error. For example, assuming a maximum divide in the scaling register and that a true count of 255 has been reached just when a drop-out occurs, then the scaler register will be automatically reset and the accumulated count of 255 will be erased from the register. Moreover, the RC time constant is influenced by changes in temperature, thereby introducing a further error-producing factor.

SUMMARY OF THE INVENTION

In view of the foregoing, the main object of this invention is to provide an improved integrator for totalizing an input signal with respect to time, the level of the signal representing a process variable being measured, thereby yielding a total reading for a given period. An integrator in accordance with the invention includes a digitally-settable drop-out circuit functioning to abruptly reduce the data fed to the totalizer to zero when the input signal falls below a predetermined level where it no longer accurately reflects the variable being measured.

More particularly, it is an object of the invention to provide an integrator having a drop-out circuit of the above type wherein accumulated counts are not lost by reason of the operation of the drop-out circuit. As a consequence, the drop-out does not introduce an error in the total reading. A significant feature of the invention is that the drop-out point is sharply defined and is repeatable. Also, the operation of the drop-out is unaffected by changes in temperature.

Yet another object of the invention is to provide an efficient and reliable drop-out circuit for an integrator whose setting is adjustable in discrete steps.

Briefly stated, these objects are attained in an integrator in accordance with the invention in which a signal representing the process variable being metered is applied to a duty cycle converter that cyclically generates a rectangular wave having an ON period whose duration is a function of the signal, the remaining portion of the cycle being an OFF period. Hence an increase in signal level is reflected by a longer ON period and an OFF period of correspondingly shortened duration in each duty cycle. The terms ON and OFF are defined, therefore, in terms of their relationship to the input signal rather than their voltage level.

Also provided is a clock that generates pulses at a constant frequency which is high relative to the repetition rate of the duty cycle. The clock pulses are supplied through a clock gate to a totalizer, the gate being normally opened only during the ON period of each cycle. A settable drop-out counter is adapted to count the clock pulses only during the OFF period of each cycle, the count reflecting the duration of this period. The drop-out counter yields an inhibiting bias only if the duration of the OFF period exceeds the value set therefor.

This bias is used to close the clock gate during the succeeding ON period to prevent clock pulses from being fed to the totalizer. In this way, the totalizer functions to count clock pulses whose number depends on the signal only in those situations where the signal is above a predetermined level. The signal, as seen by the totalizer, is reduced to zero when it falls below this level. The dropout counter is reset at the beginning of each OFF period of the duty cycle to repeat the drop-out test procedure.

OUTLINE OF DRAWINGS

For a better understanding of the invention as well as other objects and further features thereof, reference is made to the following detailed description to be read in conjunction with the accompanying drawings, wherein.

FIGS. 4A to G are waveforms illustrating the operation of the integrator.

DESCRIPTION OF INVENTION

Figures 1, 2, 3:
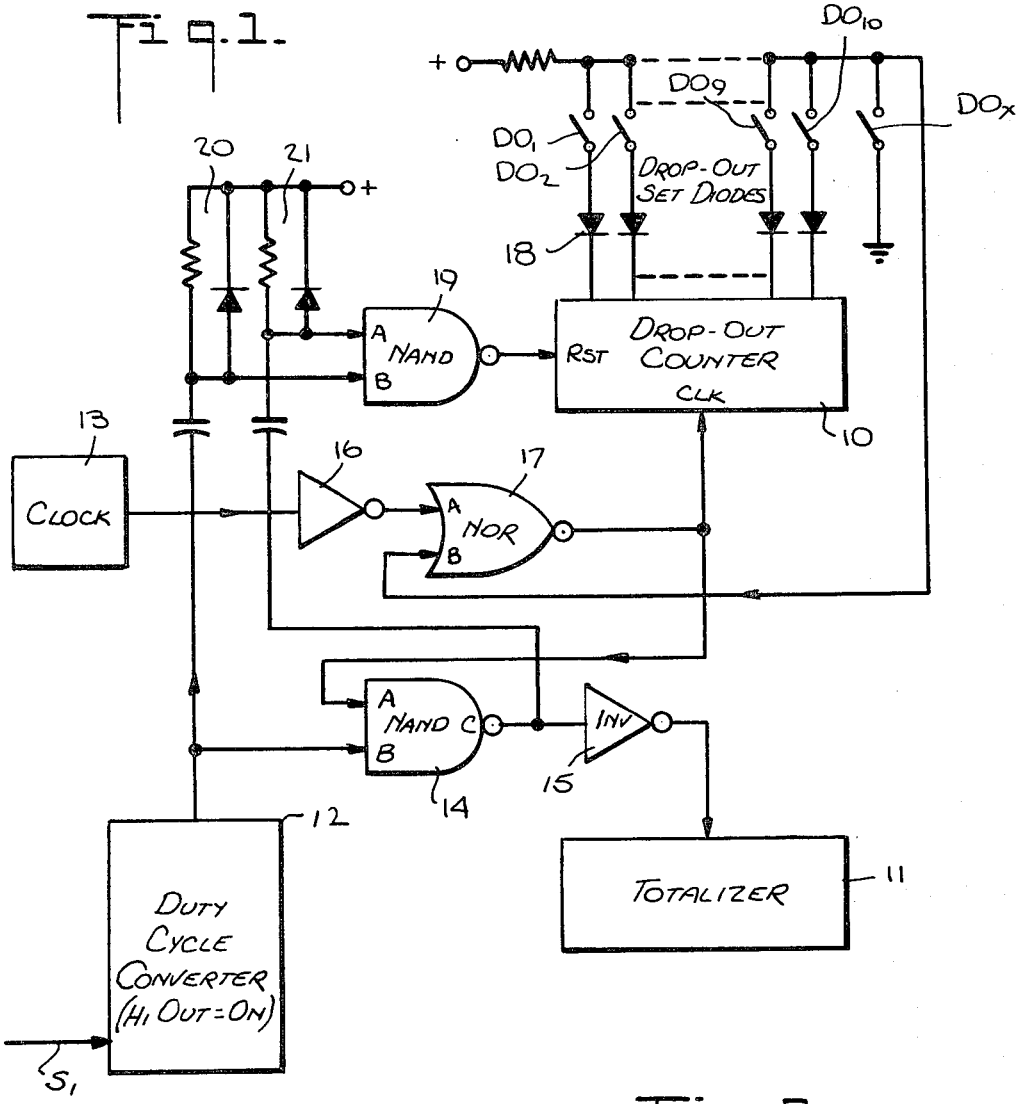
FIG. 1 is a block diagram of an integrator which includes a drop-out circuit in accordance with the invention.
FIG. 2 is the truth table for the NAND gates included in the integrator.
FIG. 3 is the truth table for the NOR gate included in the integrator.

Referring now to FIG. 1, there is shown an integrator in accordance with the invention that includes a settable drop-out counter 10 functioning to abruptly reduce to zero the signal being fed to a totalizer 11 when the level of input signal representing a process variable being metered falls below the setting of the drop-out counter. Below the set drop-out value, the input signal level does not truly reflect the variable being measured; hence it is excluded from the totalizer.

The input signal $S_1$ is applied to a duty-cycle converter 12 that cyclically generates a rectangular wave whose ON period has a duration which is a function of the level of the input signal; the higher the signal level, the shorter the OFF period of the duty cycle.

For this purpose, use may be made of the arrangement included in the above-described pneumatic integrator manufactured by Hokushin, in which a profiled vane is cyclically rotated. The vane intercepts a light beam whose position with respect to the vane is pneumatically controlled in accordance with a process variable so that the period during which the light beam is un-interrupted in each cycle is proportional to the process variable, the period of beam interruption being the OFF period, and the period in which the beam is picked up by the photosensor being the ON period.

Figure 4:
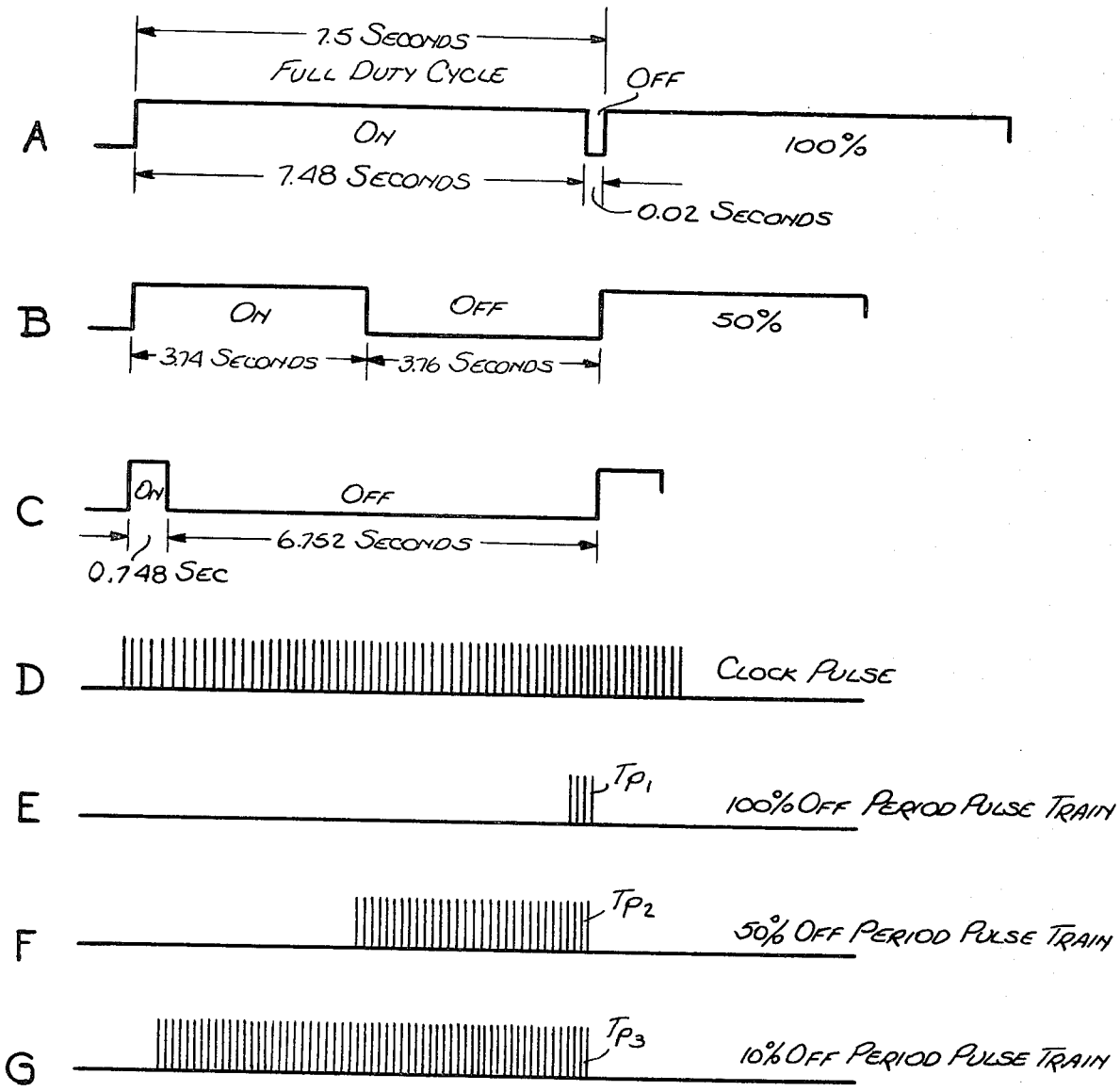

Thus, as shown in FIG. 4A, one complete cycle is assumed to have a duration of 7.5 seconds and an input signal representing a process variable at its maximum level (100% of scale) is assumed to produce an ON period which is 7.48 seconds. In this situation, the OFF period in each cycle is 0.02 seconds. But if the input signal level falls to 50%, then the ON period becomes 3.74 seconds and the OFF period becomes 3.76 seconds, as shown in FIG. 4B. And if the input signal level is reduced to 10% of full scale, then the ON period becomes 0.748 seconds and the OFF period becomes 6.752 seconds, as shown in FIG. 4C.

The duty cycle signal from converter 12 acts to gate a clock 13 which generates clock pulses at a constant frequency. In practice, clock 13 may be operated through rectifiers from the standard 60 Hz power line to produce clock pulses at four times the line frequency; that is, at a rate of 240 Hz. These clock pulses are shown in FIG. 4D, where it will be evident that the clock frequency is a high multiple of the duty cycle frequency, so that 1800 pulses are generated within each 7.5 seconds duty cycle; the greater the number of clock pulses per duty cycle, the greater the resolution of the drop-out circuit.

Clock pulses derived from clock 13 are gated by means of a NAND gate 14 whose output is fed via an inverter 15 to the totalizer 11. Gate 14 is controlled by duty cycle converter 12 in a manner whereby the gate is normally opened to supply clock pulses to the totalizer only during the ON period of each duty cycle.

Clock pulses from clock 13 are also supplied through an amplifier 16 and a NOR gate 17 to the clock input of the settable drop-out counter 10 in a manner whereby the counter acts to count the clock pulses only during the OFF period of each duty cycle, the counter being continually reset during the ON period. Hence the count accumulated in counter 10 reflects the duration of the "OFF" period.

When input signal $S_1$ applied to duty-cycle converter 12 is above the drop-out level (i.e., drop-out counter 10 does not reach the value set by its drop-out diodes), NOR gate 17 is then biased open and acts to pass clock pulses derived from clock 13 via amplifier 16. The clock pulses yielded at the output of NOR gate 17 are gated by means of NAND gate 14 whose output is fed via inverter 15 to totalizer 11. NAND gate 14 is controlled by duty-cycle converter 12 in a manner whereby the gate is normally opened to supply clock pulses to totalizer 11 only during the ON period of each duty cycle. Clock pulses yielded at the output of NOR gate 17 are also supplied to the clock input of settable drop-out counter 10 in a manner whereby the counter acts to count the pulses during the OFF period of each duty cycle, this counter being continually reset by the output of NAND gate 19 during the ON period. Hence the count accumulated in drop-out counter 10 reflects the duration of the OFF period.

Thus, as shown in FIG. 4E, during the 0.2 second OFF period (FIG. 4A) resulting from a 100% of scale input signal level, a train of clock pulses $T_{p1}$ is fed to the drop-out counter, the number of pulses in this train being relatively small since the OFF period is short. In FIG. 4F, the train of pulses $T_{p2}$ is longer, this reflecting the longer OFF period in FIG. 4B (50% of scale). And in FIG. 4G, the train of pulses $T_{p3}$ is still longer, reflecting the very long OFF period at 10% of scale (FIG. 4C).

Counter 10 acts to produce an inhibiting bias when the duration of the OFF period, as indicated by the count accumulated therein, exceeds its setting. This serves, in a manner to be later explained, to close the clock gate 17 during the succeeding ON period and to prevent clock pulses from being fed to totalizer 11 and the drop-out counter 10. In this way, totalizer 11 functions to count clock pulses whose number depends on the level of the input signal only when the input signal level is above the predetermined drop-out point, the signal being reduced to zero when it falls below this level.

For example, if the drop-out setting is at 10%, then an input signal level, say, at 9% of scale will give rise during the OFF period to more pulses per train than are shown in train $T_{p3}$ in FIG. 4G reflecting 10%. When the drop-out counter accumulates more pulses than are contained in train $T_{p3}$, it will yield the inhibiting bias to pin B or NOR gate 17 and thereby prevent pulses from being fed into the totalizer during the succeeding ON period.

To this end, drop-out counter 10 is provided with a series of drop-out switches $DO_1$ to $DO_{10}$, each being connected by a positive bias source to a stage of the counter through diode 18, and a final switch $DO_X$ connected directly to ground, the final switch when closed cutting out the drop-out. The drop-out switches, when selectively actuated, determine at which accumulated count number the counter acts to yield an inhibiting bias. In practice, instead of a switch for each step, three switches may be used in combination to provide six steps at, say, 6% increments from 3.6 to 39.3% +off.

The drop-out counter 10 is reset at the beginning of each OFF period, this being effected by means of a NAND gate 19 coupled to duty cycle converter 12. In this way, the drop-out test procedure is repeated with each duty cycle. During normal operation, drop-out counter 10 is reset by each clock pulse during the ON period by NAND gate 19 coupled to the output of NAND gate 14. In this way, the drop-out counter cannot reach the pre-set count and inhibit the totalizer clock pulses.

Thus the drop-out counter counts clock pulses only during the OFF period of the duty cycle; and if the drop-out is set, say, for 2% of the full scale of the input signal so as to provide a zero signal to the totalizer during the ON period when the input signal level is below two percent of full scale, as represented by the OFF period duration, the clock is inhibited from adding into the totalizer. Since the OFF period duration is sensed by the number of clock pulses counted during the OFF period, a single pulse beyond the number representing the OFF period related to a 2% input signal ON period, is sufficient to bring about inhibition. Again, the lower the input signal level, the shorter the ON period, and the longer the OFF period of the duty cycle.

Totalizer 10 may be constituted by any of the forms disclosed in the above-identified prior art integrators and may include a scaling circuit, an electromechanical counter and a drive therefor.

It will be seen that NAND gates 14 and 19 each have A and B input terminals and a C output terminal. The truth table for the NAND gates is shown in FIG. 2. NOR gate 17 also has A and B inputs and a C output, the truth table therefor being shown in FIG. 3.

Normal Operation

The A input of NOR gate 17 is connected via amplifier 16 to clock 13, the C output of this gate being connected to the clock input of drop-out counter 10 and to the A input of NAND gate 14. The "A" input of NOR gate 17 is normally high with negative-going clock pulses applied thereto, the "B" input of gate 17 being normally held low during non-drop-out operation. The output of NOR gate 17 is a series of positive pulses at the clock rate. For NAND gate 14, the "A" input is the series of positive pulses from NOR gate 17, the "B" input of NAND gate 14 being the output of duty-cycle converter 12.

Normally, the output of NAND gate 14 is a train of negative pulses during the ON period of the duty cycle, the number of pulses in the train depending, of course, on the duration of the ON period. The negative pulses in the train are inverted by inverter 15 and applied to totalizer 11.

The inputs "A" and "B" to NAND gate 19, which are derived from duty cycle converter 12 through resistor-diode parallel networks 20 and 21, respectively, are normally held high, input "A" being pulsed low by the clocked output of NAND gate 14 during the ON period of the duty cycle, and input "B" being pulsed low once during the OFF period. A train of clock pulses during the ON period and a single pulse is yielded by NAND gate 19 at the beginning of the OFF period, these pulses being applied to the reset terminal of drop-out counter 10 to reset the dropout counter at this point in time. Thus the drop-out counter is continuously reset during the ON period and at the beginning of each OFF period, thereby preventing the counter from reaching the pre-set drop-out point.

Drop-Out Operation

Drop-out operation takes effect when the ON period of the duty cycle is below the drop-out point, this being determined during the OFF period whose duration reflects this condition. If in the OFF period, the number of pulses fed to the drop-out counter exceeds the number representing an OFF period duration which is acceptable, the counter then produces an inhibiting bias which is applied to the "B" input of NOR gate 17, causing this input to go high and closing the gate, as a result of which no clock pulses are fed to NAND gate 14 and no pulses are added to totalizer 11 in the succeeding ON period of the duty cycle. The totalizer will not receive clock pulses until the input signal level produces clock pulses during the OFF period whose count falls below the drop-out number.

A switch contact $DO_x$ to common can be used to keep the input to terminal B of NOR gate 17 low and thereby defeat the drop-out operation for purposes of calibration or normal operation without drop-out.

While there has been shown and described a preferred embodiment of an integrator having drop-out circuit in accordance with the invention, it will be appreciated that many changes and modifications may be made therein without, however, departing from the essential spirit thereof. Thus the system can be used wherever the input signal is represented by a wave form which has a defined segment whose length decreases as the signal increases.

I claim:

1. An integrator for totalizing with respect to time an input signal representing a process variable being metered, to provide a total reading for a given time interval, the integrator having a drop-out capability functioning to reduce to zero the data fed into a totalizer when the input signal falls below a predetermined level at which it no longer accurately reflects the variable; said integrator comprising:

A. a duty-cycle converter responsive to the input signal to periodically generate a rectangular wave whose ON period has a duration which is a function of the input signal level—the higher the signal level, the shorter the resultant OFF period in the cycle; the longer the OFF period duration, the lower the input signal level;

B. a clock generating clock pulses at a constant frequency which is high relative to the duty cycle frequency;

C. means normally to supply pulses derived from the clock to said totalizer during the ON period of each duty cycle to provide a total reading of the input signal for a given time interval;

D. a settable drop-out counter adapted to carry out a test procedure by counting pulses derived from the clock during the OFF period of each cycle and to yield an inhibiting bias only when the count accumulated therein reflects an OFF period duration which exceeds the selected setting therefor;

E. means responsive to said inhibiting bias to interrupt the supply of clock pulses to said totalizer during the succeeding ON period, whereby the totalizer functions to count pulses whose number depends on the input signal only when this signal is above said predetermined level;

F. means to reset said counter at the beginning of each duty cycle OFF period, whereby the counter continuously repeats the drop-out test procedure; and G. means to reset said counter continuously during the ON period to keep the counter from reaching the drop-out count after the beginning of the ON period.

2. An integrator as set forth in claim 1, wherein said counter is digitally settable to cause it to yield said inhibiting bias when the number of pulses exceeds a selected drop-out number.

3. An integrator as set forth in claim 2, wherein said counter includes a plurality of switches which are adapted to select a desired drop-out mode setting.

4. An integrator as set forth in claim 3, wherein said counter includes an additional switch which when closed disables the drop-out mode of the counter.

5. An integrator as set forth in claim 1, wherein the means to reset the counter includes a logic gate whose respective inputs are connected to the converter to produce an output pulse for resetting the counter at the beginning of each OFF period.

6. An integrator as set forth in claim 5, wherein the clock is coupled to the clock pulse input terminal of said counter through a logic gate whose output applies clock pulses to the counter to be accumulated only during the OFF period.

7. An integrator as set forth in claim 6, wherein the output of the logic gate is also applied to a second logic gate which supplies the clock pulses to the totalizer only during the ON period of the duty cycle.

8. The method of integrating an input signal representing a process variable being metered to provide in a totalizer a total reading for a given time interval, the method excluding totalization of input signals below a predetermined low level at which the signal does not accurately reflect the variable, comprising the steps of:

A. periodically converting the input signal to a rectangular wave whose ON period has a duration which is a function of the input signal level and whose OFF period has a duration inversely related to this level, whereby when the signal level is low the duration of the OFF period is relatively long, each OFF period of a given cycle being succeeded by the ON period of the next cycle;

B. supplying to the totalizer clock pulses having a constant frequency which is high relative to the duty cycle wave frequency, only during each ON period of the cycle to produce said reading;

C. counting only during each OFF period of the cycle the number of clock pulses which appear in this period to provide a count reflecting the duration of the OFF period and to produce an inhibiting bias when the count represents an OFF period duration exceeding a pre-set value; and D. interrupting in response to said inhibiting bias the supply of said clock pulses to said totalizer in the succeeding ON period to prevent adding thereto pulses which represent an input signal whose level is below said predetermined low level.

* * * * *